United States Patent [19]

Danz

[11] Patent Number: 4,858,359

[45] Date of Patent: Aug. 22, 1989

[54] WEAPON HOLDER

[75] Inventor: J. Roger Danz, Johnson City, Tex.

[73] Assignee: Danz Research & Mfg., Inc., Johnson City, Tex.

[21] Appl. No.: 81,309

[22] Filed: Aug. 3, 1987

[51] Int. Cl.[4] ..... F41C 29/00

[52] U.S. Cl. ..... 42/94

[58] Field of Search ..... 42/94; 89/37.04; 248/105, 107, 128, 139, 143

[56] References Cited

U.S. PATENT DOCUMENTS

| | | | |
|---|---|---|---|
| 1,187,017 | 6/1916 | Snow | 248/143 |
| 1,431,058 | 10/1922 | Sutter | 42/94 |
| 1,579,552 | 4/1926 | Ludlow | 89/37.04 |
| 2,661,172 | 12/1953 | Needham | 248/107 |
| 2,664,659 | 1/1954 | Parker | 42/94 |
| 3,621,597 | 11/1971 | Price | 42/94 |
| 4,007,554 | 2/1977 | Helmstadter | 42/94 |
| 4,438,581 | 3/1984 | LaValle | 42/94 |
| 4,467,021 | 6/1987 | Groba | 42/94 |

*Primary Examiner*—Charles T. Jordan

*Attorney, Agent, or Firm*—Arnold, White & Durkee

[57] ABSTRACT

A weapon holder for sighting and shooting a weapon having a pair of arcuately-shaped support members which are joined and laterally spaced to form a rocking, load-bearing stand. Rests are provided on the weapon holder to support the weapon. An elevation lock, which is a rigid body member which defines a hole for sliding movement of the elevation lock along a support member, may be used to limit or otherwise set an elevation of the weapon muzzle.

4 Claims, 2 Drawing Sheets

WEAPON HOLDER

BACKGROUND OF THE INVENTION

1. Field of the Invention

The invention relates generally to weapon holders for muzzle-type weapons such as rifles and pistols. More specifically, the present invention relates to an improved weapon holder for sighting and shooting such weapons with speed and accuracy. The weapon holder of the invention, which may be used by hunters, marksmen, and sharp shooters, is a rocking, load-bearing stand which supports the weight of the weapon and adjusts the elevation of the weapon muzzle. The weapon holder can be used when shooting from the ground or atop another object, and may include an elevation lock for adjusting the elevation of the weapon into a set position.

2. Description of the Relevant Art

Many attempts have been made to provide various types of weapon holders. Such devices, however, are not effectively used for the dual purposes of sighting the weapon and for hunting in the field. Such devices include elevational adjustments which are slow and cumbersome, and which are thus not useful in the field where rapid sighting of the weapon is desired. Moreover, such devices require the use of flat, hard, or level surfaces due to the configuration of the device and the method of elevation adjustment. For these and other reasons, prior devices could not be used for a variety of shooting conditions on varying surfaces. Further, the prior devices were often complex and bulky, difficult to assemble, costly to manufacture, and incapable of rapid readiness for use as would be required under normal hunting conditions.

It is therefore desirable to provide a weapon holder which can be used on a variety of surfaces and in a variety of shooting positions. It is further desirable that the weapon holder be readied for use with a minimum of effort and that the weapon holder be capable of rapid adjustment to quickly sight onto a target. It is further desirable to provide such a weapon holder which is simple in design and operation to minimize costs of production.

SUMMARY OF THE INVENTION

The present invention provides such a weapon holder for sighting and shooting a weapon with improved accuracy. The weapon holder may be used by hunters, marksmen, and sharp shooters, and may be used on varying surfaces and in a variety of shooting positions. The weapon holder is lightweight for ease of transportation and is quickly readied for use.

More specifically, the weapon holder of the present invention includes a pair of arcuately-shaped support members which are joined and laterally spaced to form the load-bearing stand for supporting the weight of the weapon. The load-bearing stand is capable of rocking on the support members to rapidly adjust the elevation of the stand and the weapon muzzle. Means are provided for retaining the muzzle of the weapon and the grip of the weapon at locations along the load-bearing stand. The weapon holder may further include an elevation lock which may be used for setting an elevation of the load-bearing stand.

In a preferred embodiment of the present invention, the means for retaining the muzzle and grip of the weapon are located on the joined ends of the support members. The retaining means may preferably take the form of v-shaped rests formed by extensions from the ends of the joined support members. The retaining means or rests may further include a protective coating for preventing surface scarring or other damage to the weapon by its contact with the weapon holder. Such protective coating may be made of rubber, plastic, foam, or the like.

In an alternate embodiment of the present invention, the weapon holder may be adapted for particular use with a pistol. In such an embodiment, the weapon holder may be a curved, wishbone-shaped load-bearing stand formed of a pair of support members joined at a first end. A cross member is provided to laterally space the support members and to provide a rest for the grip or a location for a grip retaining means. A grip retaining means is preferably provided on the cross member and is a pair of inwardly-angled projections between which the grip is retained by wedging. A muzzle retaining means is also provided which is preferably located on the joined ends of the support members. The muzzle retaining means preferably takes the form of a v-shaped rest formed by extensions from the joined ends of the support members. The muzzle retaining means and the grip retaining means may further include a protective coating for preventing surface scarring or other damage to the weapon.

The weapon holder of the present invention may be advantageously used with an adjustable elevation lock. An elevation lock is simply a device positioned along the length of a support member to stop the member from rocking beyond that point. The device engages or is otherwise attached to the support member and projects from the support member to obstruct its movement. The elevation lock, which may be used to limit or otherwise set an elevation of the weapon muzzle, is preferably a rigid body member which defines a hole for sliding movement of the elevation lock along a support member. The elevation lock is moved to a position on the support member such that the weight of the weapon holder and weapon causes the edge surfaces of the hole to disalign with the support member and bind against the support member to prevent rocking of the weapon holder against the surface on which it rests. The elevation lock is preferably a rectangular body which defines a hole for slidable movement on a support member. Two or more elevation locks may be used with a single weapon holder, however, it has been found that a single elevation lock is sufficient for most purposes.

The present invention thus provides a weapon holder which may be used to sight a weapon at a target with speed and accuracy. These and other advantages of the present invention will be more fully appreciated by the following detailed description of the invention.

BRIEF DESCRIPTION OF THE DRAWINGS

This invention will further be illustrated by reference to the appended drawings which illustrate the weapon holder in accordance with the present invention.

DESCRIPTION OF THE PREFERRED EMBODIMENT

The present invention may be implemented in a number of different ways within the scope of the claims appended hereto. The presently preferred embodiments of the invention will now be described.

Figure 1:
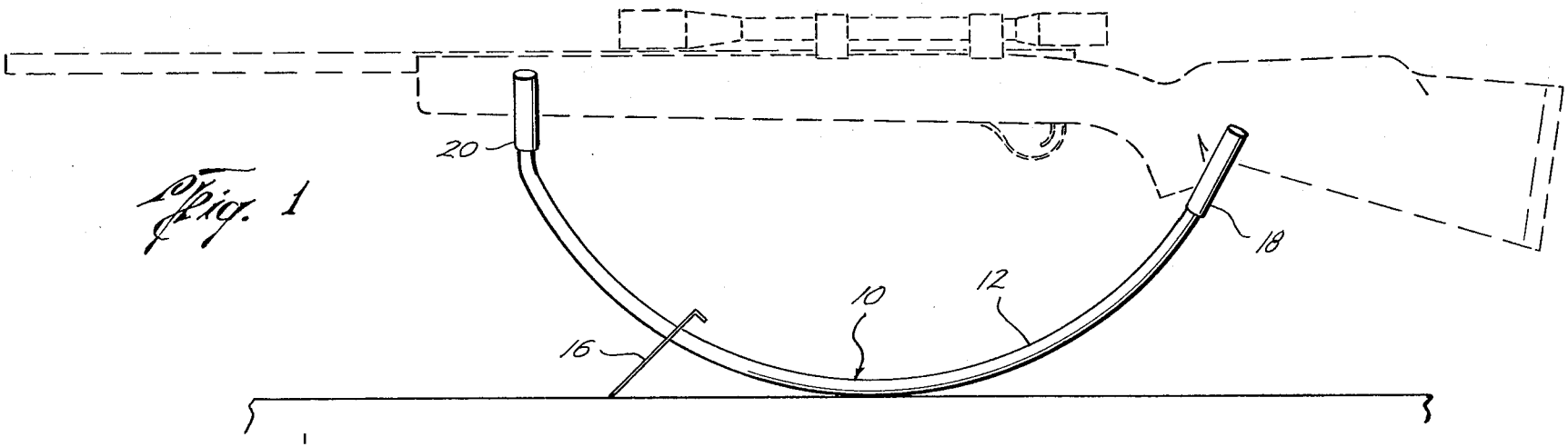
FIG. 1 is a side elevational view of a weapon holder in accordance with the present invention showing a rifle positioned therein in ghost detail.
Figure 2:
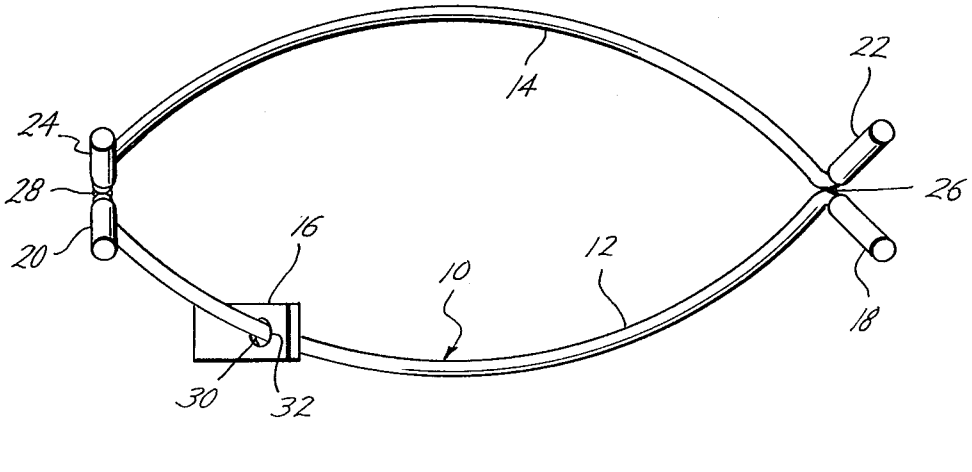
FIG. 2 is a top view of a weapon holder in accordance with the present invention.
Figure 3:
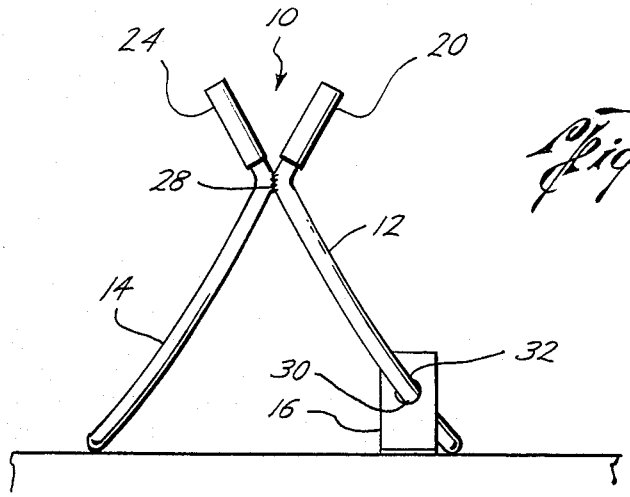
FIG. 3 is a front elevational view of a weapon holder in accordance with the present invention.

Referring now to FIGS. 1–3, the present invention is generally represented by a weapon holder 10 for muzzle-type weapons such as rifles and pistols. The weapon holder 10 as shown in FIGS. 1–3 includes a pair of arcuately-shaped rocker-like support members 12 and 14. The support members 12 and 14 may be made of any suitable material having sufficient strength to support the weight of a weapon without undue flexing or contortion. Such materials may include metal and metal alloys, aluminum, steel, stainless steel, rubber, wood and plastic.

The support members 12 and 14 are joined at the ends thereof and are laterally spaced intermediate the ends to form a load-bearing stand. Due to the arcuate shape of the support members 12 and 14, the load-bearing stand thus formed is capable of rocking on the support members.

The support members 12 and 14 are preferably of equivalent arc and shape such that the load bearing stand formed by joining the ends of the support members will be level. As demonstrated in FIG. 1, the support members 12 and 14 are of a size and arc such that two spaced points on a rifle may be supported thereon. As shown in FIG. 1, the muzzle and grip ends of the weapon are supported.

As shown in FIG. 2, the support members 12 and 14 are preferably joined at points 26 and 28. As can be appreciated, the support members could be joined in a variety of methods, such as by a screw attachment means or a clamp. The support members may also be welded together at points 26 and 28.

It may also be desirable to hingedly join the support members so that the load-bearing stand may be folded for storage and transportation. If the support members are so joined, one or more lateral cross members may be used to laterally space the support members. Such lateral cross members may be removably attached to the support members so as to fix the lateral spacing of the support members when the load-bearing stand is assembled.

The weapon holder 10 also includes means for retaining the muzzle and grip end of the weapon on the load-bearing stand formed by the support members. As shown in FIGS. 1–3, such retaining means may be formed by projections from the support members. As best shown in FIG. 2, projections 20 and 24 and projections 18 and 22 form v-shaped rests at the joined ends 26 and 28 of the support members 12 and 14. The weapon retaining means or rests may further include a protective coating to prevent surface scarring or other damage to the weapon while it is placed in the weapon holder. Such protective coating may be made of plastic, rubber, foam, or the like.

As can be appreciated of one of skill in the art, the weapon retaining means may include straps, clamps, compressible jaws, or any other form of weapon retention device. Although such devices may be useful in some applications, it is preferred that the weapon retaining means take the form of the v-shaped rests as described. The use of such v-shaped rests enables the weapon to be quickly placed and removed from the weapon holder and allows rotational adjustment of the weapon on the weapon holder to further assist the shooter in sighting a target.

The weapon holder thus described may be used in a variety of shooting positions and under a variety of shooting conditions. For example, the weapon holder could be sized for use by a hunter, marksman or sharp shooter who chooses to lay flat when shooting. In such position, the weapon holder greatly relieves the strain of the shooter in supporting the weapon above the ground and allows for quick sighting of the weapon onto a target. The weapon holder may be used on any suitably stationary surface, such as the ground, a rooftop, or a vehicle.

The weapon holder of the present invention has shown particular applicability in use where it is configured to fit within a vehicle tire rim. When so placed, the shooter may readily adjust the elevation of the weapon and may swivel the weapon within the tire rim. As can be appreciated, the weight of the weapon and the weapon holder provides frictional engagement with the tire rim thereby resisting movement. However, the frictional forces can be easily overcome by the shooter to rapidly sight his weapon. The hunter may choose to place the tire rim on the hood or roof of a vehicle to provide a comfortable shooting position.

The weapon holder as described may also be used with an adjustable elevation lock 16 for setting an elevation of the weapon holder (and thus of the weapon muzzle). The elevation lock 16 is a member which defines a hole for accepting a support member in a slidable manner. Preferably, elevation lock 16 is a rectangular member having a hole for receiving and sliding along a support member.

As shown in FIGS. 1 and 2, the elevation lock 16 may be used to adjust the elevation of the load-bearing stand. When the elevation lock 16 is perpendicular to the surface of the support member, it will readily slide along the support member 12 to a desired location. When the elevation lock 16 is in the desired location, the weight of the weapon holder 10 and the weapon will cause the elevation lock 16 to become disaligned with the support member 12. When this disalignment occurs, the upper surface 32 of the hole defined in the elevation lock 16 and the lower surface 30 of the hole defined in the elevation lock 16 will bind against the support member 12 in a manner which prevents further rocking of the load-bearing stand. This aspect is best illustrated in FIGS. 2 and 3 of the drawings.

The use of an elevation lock is especially useful when the weapon holder is to be used on a firm surface. As will be readily understood, when the shooter desires to alter the elevation of the weapon once the elevation lock is engaged, the load-bearing stand can simply be rocked to a position where the elevation lock releases, or the shooter can grasp the elevation lock and align it with the support member to release it. In either fashion, the elevation lock may be readily adjusted or moved along a support member. Additional elevation locks may be also used with the weapon holder if it is desired to provide a more stable or exact fixed position of the weapon. For example, four elevation locks could be used to prevent movement of the load-bearing stand in any direction.

Figure 4:
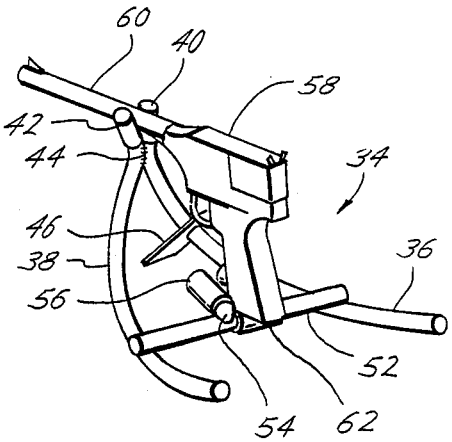
FIG. 4 is a rear perspective view of a weapon holder in accordance with the present invention having a pistol placed therein.
Figure 5:
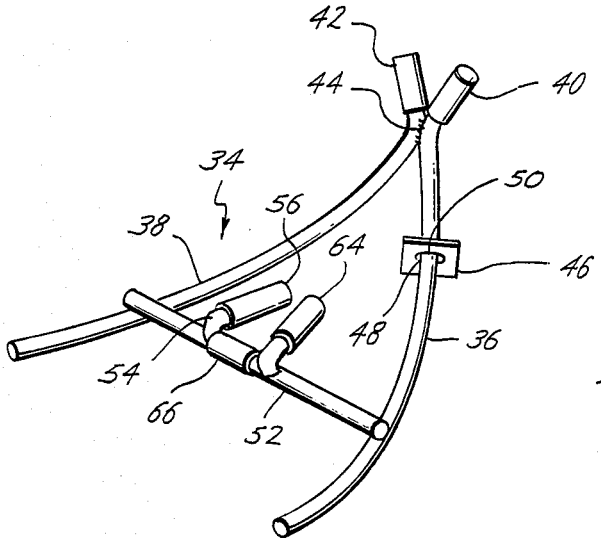
FIG. 5 is an end perspective view of the weapon holder of FIG. 4.

Referring now to FIGS. 4 and 5, an alternate embodiment of the present invention is generally represented by a weapon holder 34 for use with pistols. The weapon holder 34 as shown in FIGS. 4 and 5 includes a pair of support members 36 and 38 joined at one end and formed into a curved wishbone shaped, load-bearing stand. The cross member 52 is provided to laterally space the support members and to provide a rest or the location for a grip retaining means. The support members 36 and 38 and the cross member 52 may be made of any suitable material having sufficient strength to support the weight of a weapon without undue flexing or contortion. As stated above, such materials may include metal and metal alloys, aluminum, steel, stainless steel, rubber, wood and plastic.

The support members 36 and 38 are joined at a first end and are laterally spaced to form a load-bearing stand. Due to the curved wishbone shape of the support members when joined, the load-bearing stand thus formed is capable of rocking on the support members.

The support members 36 and 38 are preferably of an equivalent arc and shape such that the load-bearing stand is level. As shown in FIG. 4, the support members 36 and 38 are of a size and arc such that the muzzle of the pistol and the grip of the weapon may be supported thereon.

The support members 36 and 38 are preferably joined at point 44. As can be appreciated, the method of joining could take a variety of forms such as by a screw attachment means or clamp. The support members 36 and 38 may also be welded at point 44.

The weapon holder 34 includes means for retaining the muzzle of the pistol on the load-bearing stand formed by the support members. As shown in FIG. 4, such retaining means may be formed by projections from the support members. As shown, projections 40 and 42 form a v-shaped rest at the joined end of the support members 36 and 38. The muzzle retaining means or rest may further include a protective coating to prevent surface scarring or other damage to the weapon while it is placed in the weapon holder. Such protective coating may be of plastic, rubber, foam, or the like.

The weapon holder 34 may also include a grip retaining means located on cross member 52. Such grip retaining means may take the form of a pair of inwardly angled projections 54 and 64. Projections 54 and 64 are angled such that the grip end of a pistol may be wedged therebetween for retention on cross member 52. As can be appreciated by one of skill in the art, the grip retaining means could take a variety of forms including spring or screw clamps, etc. Projections 54 and 64 are located such that the grip end of the pistol is held in the center of cross member 52 so that the pistol is aligned with the load-bearing stand. Projections 54 and 64 may further include a protective coating for preventing damage to the weapon. Additionally, a protective coating may be provided on cross member 52 for a similar purpose. Such protective coatings are generally referenced as numerals 56 and 66.

The weapon holder 34 as thus described may also be used with an elevation lock 46. As described above, elevation lock 46 is a member which defines a hole for accepting a support member in a slidable manner. Preferably, elevation lock 46 is a rectangular member having a hole for receiving and sliding along the support member.

The present invention has been described in connection with specific embodiments. However, it will be apparent to those skilled in the art that variations from the illustrated embodiments may be undertaken without departing from the spirit and scope of the invention. Such variations will be apparent in view of the above disclosure.

What is claimed is:

1. A pistol holder comprising:

a curved wishbone-shaped load-bearing stand formed of a pair of support members joined at a first end;

a first rest for retaining the muzzle of a pistol on the joined end of the support members;

a cross member spaced along the support members from the first rest which also interengages the support members;

a second rest for retaining the grip of the pistol on the cross member; and an adjustable elevation lock on one of the support members for adjusting the elevation of the load-bearing stand, the elevation lock comprising a body member defining a hole which receives one of the support members in slidable relation along the support member.

2. The weapon holder of claim 1 wherein the elevation lock is formed of a generally rectangular body having a hole for slidable engagement on one of the support members.

3. The pistol holder of claim 1, wherein the muzzle retaining means is a v-shaped rest formed by extensions from the ends of the joined support members.

4. The pistol holder of claim 1, wherein the grip retaining means is a pair of inwardly-angled projections wedging between the projections and rests on the cross member.

* * * * *